US009518377B2

(12) United States Patent
Won et al.

(10) Patent No.: US 9,518,377 B2
(45) Date of Patent: Dec. 13, 2016

(54) METHOD FOR CONTROLLING DRIVING FLOW OF WHEEL EXCAVATOR

(71) Applicant: HYUNDAI HEAVY INDUSTRIES CO., LTD., Ulsan (KR)

(72) Inventors: Jin Hee Won, Yongin-si (KR); Jun Seong Lim, Ulsan (KR); Moon Kyu Choi, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 31 days.

(21) Appl. No.: 14/434,772

(22) PCT Filed: Aug. 7, 2013

(86) PCT No.: PCT/KR2013/007127
§ 371 (c)(1),
(2) Date: Apr. 10, 2015

(87) PCT Pub. No.: WO2014/069759
PCT Pub. Date: May 8, 2014

(65) Prior Publication Data

US 2015/0233093 A1 Aug. 20, 2015

(30) Foreign Application Priority Data

Oct. 31, 2012 (KR) ..... 10-2012-0122667

(51) Int. Cl.
*E02F 9/22* (2006.01)
*E02F 9/26* (2006.01)
*E02F 3/43* (2006.01)

(52) U.S. Cl.
CPC ..... *E02F 9/2235* (2013.01); *E02F 9/2232* (2013.01); *E02F 9/2242* (2013.01); *E02F 9/267* (2013.01); *E02F 3/43* (2013.01)

(58) Field of Classification Search
CPC ..... E02F 3/43; E02F 9/2232; E02F 9/2235; E02F 9/267
See application file for complete search history.

(56) References Cited

U.S. PATENT DOCUMENTS 5,259,192 A * 11/1993 Karakama ..... E02F 9/2235 60/426
5,845,223 A * 12/1998 Song ..... E02F 9/2235 701/50

(Continued)

FOREIGN PATENT DOCUMENTS

JP 4338758 B2 7/2009
KR 10-2003-0056347 A 7/2003

(Continued)

OTHER PUBLICATIONS

International Search Report for PCT/KR2013/007127 mailed Oct. 23, 2013 from Korean Intellectual Property Office.

*Primary Examiner* — Dale W Hilgendorf
(74) *Attorney, Agent, or Firm* — Paratus Law Group, PLLC

(57) ABSTRACT

The present invention controls a proportional control valve controlling the maximum flow of the flow pump to perform controlling the maximum flow of the hydraulic oil pump after checking whether the pump joint control is normal, receiving a flow value of the flow pump controlled by the proportional control valve, checking an error when the flow value received during a control of the maximum flow has an error, and assigning a weight value to the checked error to compensate for the flow value. Therefore, the present invention may decrease a number of an engine revolution speed and lower a driving fuel consumption and reduce a driving noise.

4 Claims, 3 Drawing Sheets

(56) References Cited

U.S. PATENT DOCUMENTS

| | | | | | |
|---|---|---|---|---|---|
| 6,055,851 | A * | 5/2000 | Tanaka | E02F 9/2235 | 73/40 |
| 6,087,945 | A * | 7/2000 | Yasuda | E02F 9/2235 | 73/121 |
| 7,281,373 | B2 * | 10/2007 | Kim | E02F 9/2235 | 60/430 |
| 2006/0137337 | A1 | 6/2006 | Kim | | |
| 2009/0056324 | A1 | 3/2009 | Itakura et al. | | |
| 2011/0276212 | A1 * | 11/2011 | Wu | E02F 9/2235 | 701/22 |
| 2012/0085440 | A1 | 4/2012 | Pfaff et al. | | |
| 2013/0283775 | A1 * | 10/2013 | Park | E02F 9/2235 | 60/420 |

FOREIGN PATENT DOCUMENTS

| | | | |
|---|---|---|---|
| KR | 10-2006-0075702 | A | 7/2006 |
| KR | 10-0812953 | B1 | 3/2008 |
| KR | 10-2010-0109643 | A | 10/2010 |

* cited by examiner

METHOD FOR CONTROLLING DRIVING FLOW OF WHEEL EXCAVATOR

CROSS REFERENCE TO PRIOR APPLICATION

This application is a National Stage Patent Application of PCT International Patent Application No. PCT/KR2013/007127 (filed on Aug. 7, 2013) under 35 U.S.C. §371, which claims priority to Korean Patent Application No. 10-2012-0122667 (filed on Oct. 31, 2012), which are all hereby incorporated by reference in their entirety.

TECHNICAL FIELD

The present invention relates to a method for controlling a driving flow of a wheel excavator and more particularly to a method for controlling a driving flow of a wheel excavator using a joined flow of two hydraulic pumps to increase a driving efficiency and to decrease a number of an engine revolution speed.

BACKGROUND ART

Generally, an excavator uses a rotational kinetic energy from the engine for minimizing an engine fuel loss in a working standby to discharge a working hydraulic oil through a main-line in a variable capacity pump of a main pump, returns the working hydraulic oil through the main-line to a tank through a bypass release pump when a main spool does not receive any signal through a neutral position port and transfers a pressure formed at an orifice to a pump regulator through a pump control line to control a tilting angle of the pump and to decrease a discharged flow.

Korean Patent Publication No. 10-2003-0056347 relates to the fuel economy and the pump for excavator minimum stream flow way of regulation letting enhance durability of the equipment the pump control including the modulation of the pump input horse power and pump inclined-angle etc, is done the power loss is minimized as to the excavator capable of the flow rate variable control of pump in the working standby. And the pump for excavator minimum stream flow way of regulation organizing the engine, the acceleration factor, the main control valve, the central control computer, the electronic proportion pressure reducing valve and solenoid valve in order to minimize the engine fuel loss in the working standby of the excavator and controls the minimum stream flow of pump and it adds the signal to the electronic proportion pressure reducing valve setting up the shuttle valve between the pilot line of the pilot pump controlled with the negative line and solenoid valve and operates the solenoid valve to the signal of the central control computer receiving the signal of the work standby state and the comparison senses the pressure in the shuttle valve and controls the pump regulator input torque at the central control computer operating the inclined-angle of pump to the minimum and receives the signal of the work standby state and controls the pump input torque to the minimum. According to a described technology, there are advantages that a power loss in an idle time can be minimized to reduce a fuel, improve an endurance and provide an environment-friendly construction equipment.

However, the excavator has disadvantages that engine revolution speed (for example, 2015 (rpm)) is increased in a driving time, a driving fuel consumption is increased and a driving noise is increased because only flow of a hydraulic pump is used as a driving power.

TECHNICAL PROBLEM

One embodiment of the present invention proposes to providing a driving flow control method of a wheel excavator so that the one embodiment uses a joined flow of two hydraulic pumps in the wheel excavator to decrease a number of an engine revolution speed and to enhance a driving fuel consumption, improve a driving efficiency and reduce a driving noise.

TECHNICAL SOLUTION

In one embodiment, a method for controlling a driving flow of a wheel excavator receiving a pressure oil discharged from a hydraulic oil pump to perform controlling a pump joint control and to control a maximum oil amount of the pump in the wheel excavator includes controlling a proportional control valve controlling the maximum flow of the flow pump to perform controlling the maximum flow of the hydraulic oil pump after checking whether the pump joint control is normal, receiving a flow value of the flow pump controlled by the proportional control valve, checking an error when the flow value received during a control of the maximum flow has an error, and assigning a weight value to the checked error to compensate for the flow value.

In one embodiment, checking the error may include calculating difference between the received flow value and a currently flown flow value as the error In one embodiment, assigning the flow value may include calculating the weight value to the checked error the flow value: and checking whether the calculated flow value is out of a predetermined range.

In one embodiment, checking whether out of the predetermined range may include limiting upper and lower bound of the calculated flow value is not out of the predetermined range as the flow value.

TECHNICAL EFFECTS

A driving flow control method of a wheel excavator according to an example embodiment of the present invention may include joining a pressure oil discharged from two hydraulic oil pumps to use a joined flow thereby the wheel excavator improves a driving efficiency, decreases a number of an engine revolution speed and a driving fuel consumption, increases a driving fuel efficiency and reduces a driving noise.

MODE FOR INVENTION

Figure 1:
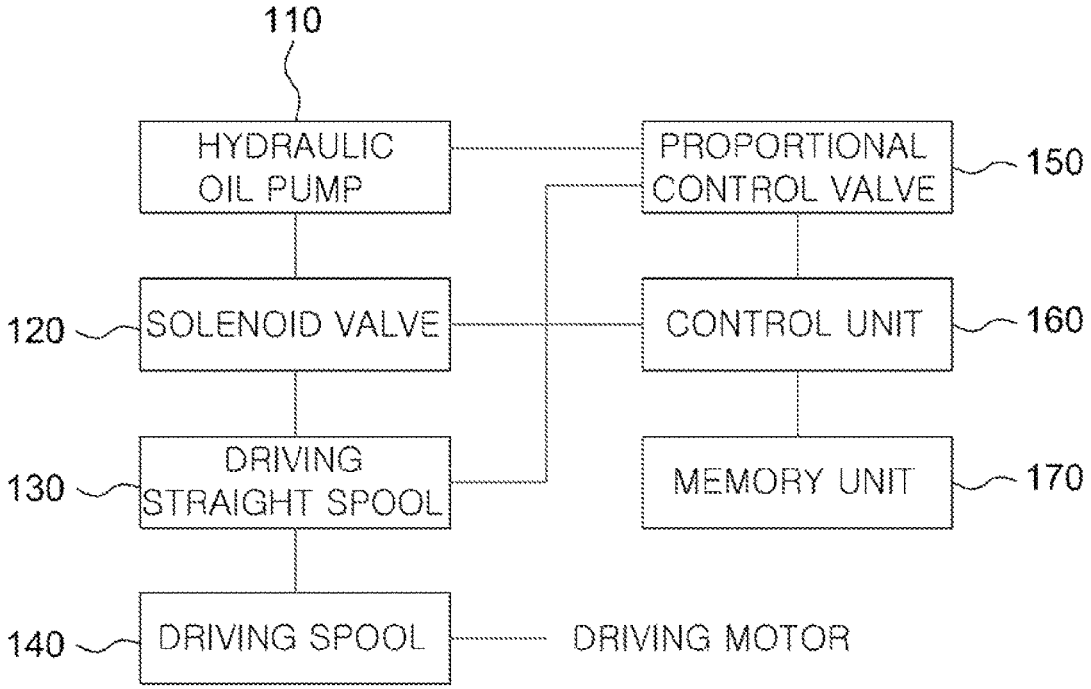
FIG. 1 is a configuration diagram illustrating a driving flow control device of a wheel excavator according to an example embodiment of the present invention.

The embodiments and the configurations depicted in the drawings are illustrative purposes only and do not represent all technical scopes of the invention, so it should be understood that various equivalents and modifications may exist at the time of filing this application. Although a preferred embodiment of the disclosure has been described for illustrative purposes, those skilled in the art will appreciate that various modifications, additions and substitutions are possible, without departing from the scope and spirit of the invention as disclosed in the accompanying claims.

FIG. 1 is a configuration diagram illustrating a driving flow control device of a wheel excavator according to an example embodiment of the present invention.

Referring to FIG. 1, a driving flow control device of a wheel excavator includes a hydraulic oil pump 110, a solenoid valve 120, a driving straight spool 130, a driving spool 140, a proportional control valve 150, a control unit 160 and a memory unit 170.

The hydraulic oil pump 110 includes first and second hydraulic oil pumps and the first and second hydraulic oil pumps play a role on discharging a pressure oil to discharge the pressure oil formed by providing a pressure through an engine drive to the solenoid valve.

Herein, the driving flow control device of the wheel excavator further includes a first hydraulic oil pump pressure sensor (not shown for conveniences' sake) detecting a pressure of a pressure oil received from a regulator of a first hydraulic oil pump to input a value of a first hydraulic oil pressure to the control unit 160. Also, the driving flow control device of the wheel excavator further includes a first pump negative pressure sensor (not shown for convenience's sake) detecting a MCV (Main Control Valve) negative pressure of the first hydraulic oil pump to input a value of a first pump negative pressure to the control unit 140.

And the driving flow control device of the wheel excavator further includes a second hydraulic oil pump pressure sensor (not shown for conveniences' sake) detecting a pressure of a pressure oil received from a regulator of a second hydraulic oil pump to input a value of a second hydraulic oil pressure to the control unit 160. Also, the driving flow control device of the wheel excavator further includes a second pump negative pressure sensor (not shown for convenience's sake) detecting a MCV negative pressure of the second hydraulic oil pump to input a value of a second pump negative pressure to the control unit 160.

The solenoid valve 120 plays a role on joining pressure oils discharged from the first and second hydraulic oil pumps to the driving straight spool 130 to join the pressure oil discharged from the first hydraulic oil pump to the driving straight spool 130 or to join the pressure oil discharged from the second hydraulic oil pump to the driving straight spool 130 according to a control of the control unit 160.

The driving straight spool 130 plays a role on receiving the pressure oil from the first and second hydraulic oil pumps to receive the pressure oils discharged from the first and second hydraulic oil pumps and to discharge the received pressure oils to the driving spool 140.

The driving spool 140 receives the joined pressure oil discharged from the driving straight the spool 130 to drive a driving motor.

The proportional control valve 150 controls a maximum flow of the first and second hydraulic pumps to limit the maximum flow of the first and second hydraulic pumps according to a control of the control unit 160.

Herein, the driving flow control device of the wheel excavator further includes a proportional control valve pressure sensor (not shown for convenience's sake) detecting the pressure of the proportional control valve pressure 150 to input a value of the pressure of the proportional control valve to the control unit 160.

The control unit 160 performs a pump join control function controlling an operation of the solenoid valve 120, a pump maximum flow control function controlling a pump maximum flow to limit an engine revolution speed through a control of the proportional control valve 150 and a driving system failure diagnostics function securing a driving safety through a failure diagnostics of hydraulic component and system.

Herein, the control unit 160 controls an operation of the solenoid valve 120 through the pump join control function so that a pressure value detected in the first hydraulic oil pump pressure sensor and a pressure value detected in the second hydraulic oil pump pressure sensor are equivalent.

And the control unit 160 controls a maximum flow of the hydraulic oil pump through the pump maximum flow control function including a control of the proportional control valve 150 so that a flow provided to the driving motor is too much to be over-run when a discharge pressure of a hydraulic pump is lowered. For example, the control unit 160 maintains a maximum permission flow (e.g., 165 (LPM: Liter Per Minute)) discharge of the driving motor based on a joined flow of the first and second hydraulic oil pumps and limits a driving maximum engine revolution speed as 1800(rpm).

And the control unit 160 controls an operation of the solenoid valve 120 through the driving system failure diagnostics in order not to perform the pump join control function to operate with a pump (i.e., the first or second hydraulic oil pump) when a pump join control function or a pump maximum flow control function may not operate in a driving mode.

Herein, when a hydraulic component is diagnosed as abnormal in the driving system failure diagnostics function, the control unit 160 diagnoses whether there is high voltage short, less than 1.0V low voltage short or less than 0.5V low voltage short in the first hydraulic oil pump pressure sensor, the second hydraulic oil pump pressure sensor, the first pump negative pressure sensor, the second pump negative pressure sensor and high voltage short circuit of the proportional control valve pressure sensor and there is open or short in the first and second solenoid valves, to control an operation of the solenoid valve 120 to operate with a pump (i.e., the first or second hydraulic oil pump).

And when a system is diagnosed as abnormal in the driving system failure diagnostics function, the control unit 160 compares a pressure value of a first pressure oil detected by the first hydraulic pump pressure sensor and a pressure value of a second pressure oil detected by the second hydraulic pump pressure sensor to obtain difference between the pressure values and determines that the system is abnormal when the obtained difference exceeds a predetermined value (e.g., 100 bar) to control an operation of the solenoid valve 120 when the system is abnormal and to operate with a pump (Le., the first or second hydraulic oil pump).

Also the control unit 160 compares a first pump negative pressure value detected by a first pump negative pressure sensor and a second pump negative pressure value detected by a second pump negative pressure sensor to obtain a difference between the pump negative pressure values and determines that the system is abnormal when the obtained difference exceeds a predetermined value (e.g., 100 bar) to control an operation of the solenoid valve 120 when the system is abnormal and to operate with a pump (i.e., the first or second hydraulic oil pump), The memory unit 170 stores program and data necessary for a control operation of the control unit 160 and particularly, stores a reference for a pressure difference of pressure oils and a reference for a pump negative pressure difference for determining whether the system is abnormal or not.

Figure 2:
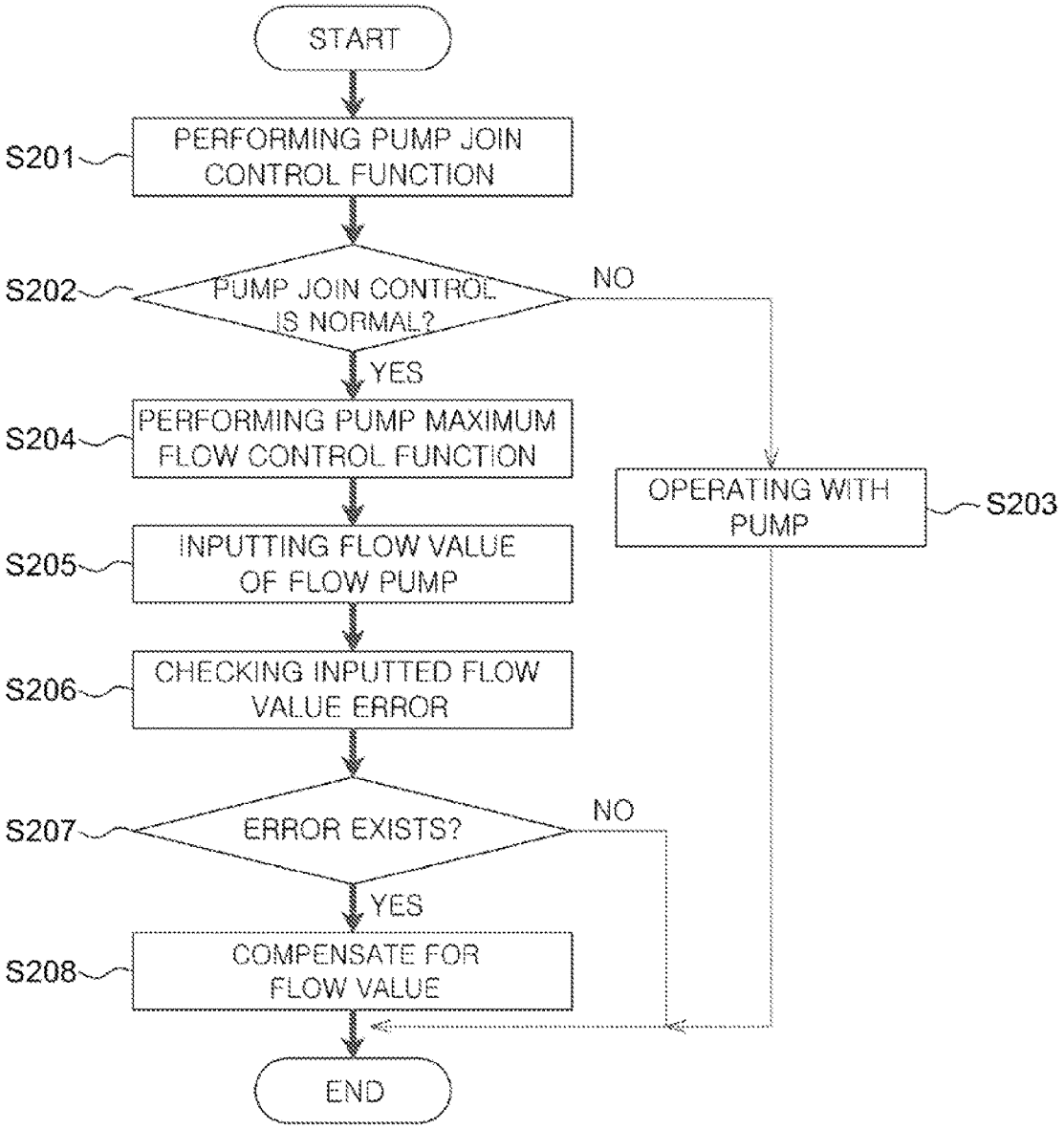
FIG. 2 is a flowchart illustrating a driving flow control method of a wheel excavator according to an example embodiment of the present invention.

FIG. 2 is a flowchart illustrating a driving flow control method of a wheel excavator according to an example embodiment of the present invention.

Referring to the FIG. 2, the driving flow control method of the wheel excavator discharges the pressure oil formed by providing the pressure through the first hydraulic oil pump engine drive to the driving straight spool 130 via the solenoid valve 120.

Herein, the first hydraulic oil pump pressure sensor detects a pressure of a pressure oil provided to a regulator of the first hydraulic oil pump to input a detected value of the first hydraulic oil pressure to the control unit 160 and also, the first pump negative pressure sensor detects an MCV negative pressure of the first hydraulic pump to input a detected value of the first pump negative pressure to the control unit 160.

And the pressure oil formed by providing the pressure by a drive of the second hydraulic oil pump engine is discharged to the driving straight spool 130 via the solenoid valve 120.

Herein, the second hydraulic oil pump pressure sensor detects a pressure of a pressure oil provided to a regulator of the second hydraulic oil pump to input the detected value of the second hydraulic oil pressure to the control unit 160 and also, the second pump negative pressure sensor detects an MCV negative pressure of the second hydraulic pump to input the detected value of the second pump negative pressure to the control unit 160.

Accordingly, the control unit 160 receives a pressure value of the first pressure oil detected in the first hydraulic oil pump pressure sensor and receives a pressure value of the second pressure oil detected in the second hydraulic oil pump pressure sensor to perform the pump join control function controlling an operation of the solenoid valve 120 so that a pressure value of the first pressure oil inputted from the first hydraulic oil pump pressure sensor and the pressure value of the second pressure oil inputted from the second hydraulic oil pump pressure sensor are equivalent (S201).

And the control unit 160 checks whether a pump join control function in the above step S201 is normally performed through the driving system failure diagnostics function (S202) and controls an operation of the solenoid valve 120 in order not to perform the pump join control function to operate with a pump (i.e., the first or second hydraulic oil pump) when the pump join control function is determined as inoperable (S203).

On the other hand, when the pump join control function in the above step S202 is normally performed, the solenoid valve 120 joins pressure oils discharged from the first and second hydraulic oil pumps to the driving straight spool 130.

Accordingly, the driving straight spool 130 receives the pressure oils from the first and second hydraulic oil pumps. Herein, the driving straight spool 130 joins the pressure oil discharged via the solenoid valve 120 from the first hydraulic oil pump and the pressure oil discharged via the solenoid valve 120 from the second hydraulic oil pump to discharge the joined pressure oils to the driving straight spool 130.

Then, the driving spool 140 receives a joined pressure oil discharged through the driving straight spool 130 to drive the driving motor. Herein, the control unit 160 performs the pump maximum flow control function controlling a maximum flow of the first and second hydraulic pumps through the control of the proportional control valve 150 so that a flow provided to the driving motor is too much to be over-run when a discharge pressure of the first and second hydraulic pumps is lowered (S204).

Herein, the proportional control valve pressure sensor detects a pressure of the proportional control valve 150 to input the detected proportional control valve flow value to the control unit 160 (S205).

The control unit 160 checks whether there is an error in a flow value received from the proportional control valve pressure sensor during a control of the pump maximum flow (S206, S207) and herein, calculates a difference between the received flow value and a currently flown flow value as the error value.

The control unit 160 performs an operation in the above step S201 when there is no error in the above steps S206 and S207 and calculates a flow value assigning a weight value to the checked error to compensate for a flow value when there is an error.

In one embodiment, the proportional control valve 150 uses a proportion operation, integration operation and differentiation operation on a previous flow value to calculate a current flow value for a compensation calculation. Herein, the proportion operation is used for multiplying an error value of the proportion control valve 150, the integration operation is used for multiplying the error value into an addition of the error value and the previous flow value and the differentiation operation is used for multiplying the error value into a difference of the error value and the previous flow value.

The control unit 160 assigns a weight value to the check error to check whether a flow value calculated when the flow value is calculated is out of a predetermined range (S208) and herein, limits the flow value to upper and lower bounds of the calculated flow value is not out of the predetermined range.

In one embodiment, when a flow value for compensation is less than 10, the flow value is replaced with a value of 10 and when a flow value for compensation is greater than a value of 700, the flow value is replaced with 700.

The control unit 160 assigns a weight value to the checked error to compensate for a flow value and then performs an operation in the above step S201 again.

Figure 3:
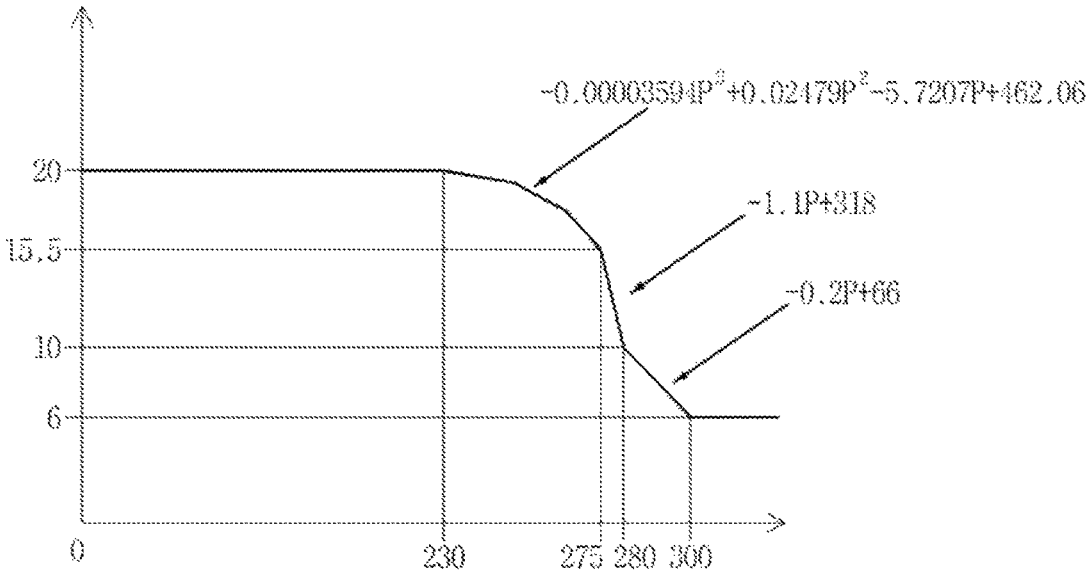
FIG. 3 is a graph illustrating a relationship between a pressure of a hydraulic pump and a pressure of a proportional control valve by a driving flow control method of a wheel excavator in FIG. 1.

FIG. 3 is a graph illustrating a relationship between a pressure of a hydraulic pump and a pressure of a proportional control valve by a driving flow control method of a wheel excavator in FIG. 1.

Referring to the FIG. 3, the horizontal axis indicate the hydraulic oil pump and the vertical axis indicate the proportional valve pressure.

A response speed of an engine is detected with a test result of driving a wheel excavator because a response speed of an engine is different in every wheel excavator Although a preferred of a disclosure has been described for illustrative purposes, those skilled in the art will appreciate that various modifications, additions and substitutions are possible, without departing from the scope and spirit of an invention as disclosed in the accompanying claims.

The invention claimed is:

1. A method for controlling a driving flow of a wheel excavator receiving pressure oil discharged from a first hydraulic oil pump and a second hydraulic oil pump the method comprising:

checking whether pump joint control as between the first hydraulic pump and the second hydraulic oil pump is normal;

controlling a proportional control valve to control a maximum flow of a flow pump controlling a maximum flow of the first hydraulic oil pump and the second hydraulic oil pump;

receiving a flow value of the flow pump controlled by the proportional control valve;

checking an error when the flow value received during a control of the maximum flow has an error, and assigning a weight value to the checked error to compensate for the flow value, wherein checking the error includes calculating a difference between the received flow value and a current flow value, and wherein the current flow value is calculated by a proportion operation used for multiplying an error value of the proportional control valve, an integration operation used for multiplying the error value into an addition of the error value and a previous flow value, and a differentiation operation used for multiplying the error value into a difference of the error value and the previous flow value.

2. The method of claim 1, wherein assigning the weight value to the checked error includes assigning the weight value to the checked error to calculate the flow value; and checking whether the calculated flow value is out of a predetermined range.

3. The method of claim 2, wherein checking whether the calculated flow value is out of the predetermined range includes setting upper and lower bounds of the calculated flow value and determining whether the calculated flow value is inside the predetermined range or outside the predetermined range.

4. The method of claim 3, wherein the setting upper and lower bounds of the calculated flow value includes:

replacing the compensated flow value with a first predetermined value when the compensated flow value is less than the first predetermined value; and replacing the compensated flow value with a second predetermined value when the compensated flow value is greater than the second predetermined value.

* * * * *